US006361138B1

(12) United States Patent
Seino et al.

(10) Patent No.: US 6,361,138 B1
(45) Date of Patent: Mar. 26, 2002

(54) INK JET PRINTING APPARATUS AND INK CARTRIDGE

(75) Inventors: Takeo Seino; Takahiro Naka; Satoshi Shinada, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/434,125

(22) Filed: Nov. 5, 1999

(30) Foreign Application Priority Data

Nov. 5, 1998 (JP) ..... 10-314889
Sep. 29, 1999 (JP) ..... 11-275808

(51) Int. Cl.[7] ..... B41J 29/393
(52) U.S. Cl. ..... 347/19; 347/23; 347/86
(58) Field of Search ..... 347/23, 86, 49, 347/19, 30, 7; 358/1.16, 1.12, 296, 298, 504

(56) References Cited

U.S. PATENT DOCUMENTS 5,049,898 A * 9/1991 Arthur et al. ..... 347/86
5,124,720 A * 6/1992 Schantz ..... 347/19
5,764,253 A * 6/1998 Uchikata et al. ..... 347/23
5,812,156 A * 9/1998 Bullock et al. ..... 347/19
6,000,778 A * 12/1999 Koitabashi et al. ..... 347/23
6,019,450 A * 2/2000 Mochizuki et al. ..... 347/23
6,056,386 A * 5/2000 Nohata et al. ..... 347/19
6,106,097 A * 8/2000 Otani et al. ..... 347/23
6,126,265 A * 10/2000 Childers et al. ..... 347/23
6,196,670 B1 * 3/2001 Saruta ..... 347/86
6,206,506 B1 * 3/2001 Takemura et al. ..... 347/49

FOREIGN PATENT DOCUMENTS

| | | | |
|---|---|---|---|
| EP | 0 694 404 A2 * | 1/1996 | |
| EP | 0 778 140 A2 | 6/1997 | ..... B41J/2/165 |
| EP | 0 854 044 A2 | 7/1998 | ..... B41J/2/175 |
| EP | 0 985 537 A1 | 3/2000 | ..... B41J/2/175 |
| JP | Hei. 6-155758 | 6/1994 | |
| JP | Hei. 7-309018 | 11/1995 | |
| WO | 98/04414 | 2/1998 | ..... B41J/2/17 |

* cited by examiner

*Primary Examiner*—N. Le
*Assistant Examiner*—Shi-wen Hsieh
(74) *Attorney, Agent, or Firm*—Sughrue Mion, PLLC

(57) ABSTRACT

An ink cartridge (1, 2) is provided with a rewritable storage system (32, 42). The storage system stores therein data concerning the operation history of a cleaning system in a rewritable mode. The cleaning operation that has been performed during the actual use of the printing apparatus can be recognized precisely based on the data concerning the operation history.

30 Claims, 7 Drawing Sheets

INK JET PRINTING APPARATUS AND INK CARTRIDGE

BACKGROUND OF THE INVENTION

This invention relates to a printing apparatus which receives ink from a replaceable ink cartridge and ejects ink droplets through nozzle openings to carry out printing on a record medium. This invention also relates to an ink cartridge mountable to the printing apparatus.

An ink jet printing apparatus includes a print head and an ink cartridge that contains ink to be supplied to the print head. The print head is typically constructed such that a drive signal is fed to a piezoelectric vibrator, a heating system, etc. in response to print data to pressurize supplied ink by energy generated by the piezoelectric vibrator, the heating system, etc., thereby ejecting ink droplets through nozzle openings.

The print quality depends not only on the resolution of the print head and but also largely on the viscosity of ink, the degree of ink spread on a record medium, etc. Therefore, in order to improve the print quality, various attempts have been made for obtaining an optimal ink characteristic, and an optimal driver for the print head, which is optimized to characteristic of the currently used ink or the improved ink. Further, optimal maintenance conditions have been considered with respect to a period of idle ejection, application of forcible ink ejection in a capping state, etc. to prevent clogging of the nozzle openings.

It is, however, not guaranteed that a user can fully enjoy the initial and intended performance of the ink cartridge thus carefully designed by the manufacturer because the ink cartridge may be used in different ways depending on environments of the individual user.

SUMMARY OF THE INVENTION

It is, therefore, an object of the invention to provide an ink jet printing apparatus that can conform to how a user uses an ink cartridge.

It is another object of the invention to provide an ink cartridge adapted to the ink jet printing apparatus.

To attain the above-noted and other objects, the present invention provides an ink jet printing apparatus and/or an ink cartridge, which is characterized by a storage system that can store therein data on operation history of a cleaning system.

On the basis of the data stored in the storage system, the printing apparatus can recognize a manner of how an ink cartridge was used by a user, and/or conform to how the user uses the ink cartridge.

If the ink cartridge with the data stored in the storage system is collected or returned to the manufacturer, the use state of the ink cartridge and the operation state of the printing apparatus can recognized precisely based on the data concerning cleaning stored in the storage system added to the ink cartridge.

An ink jet printing apparatus according to a preferred embodiment of the invention includes: an ink jet print head that receives ink from an ink cartridge provided with a rewritable storage system, a cleaning system that recovers an ink droplet ejecting capability of the print head, and a system that reads and writes data from and onto the storage system, wherein the storage system has an area capable of storing therein data on operation history of the cleaning system. Therefore, the ink cartridge that is significantly advantageous in portability in comparison to the printing apparatus can be collected easily, and the use state of the ink cartridge can be recognized precisely based on the data stored in the storage system. Advice about appropriate steps to be taken can be given to the customer in response to complaint of the customer. The performance of the printing apparatus and the ink cartridge in actual use can be investigated to be fed back into development and design.

The present disclosure relates to the subject matter contained in Japanese patent application Nos. Hei. 10-314889 (filed on Nov. 5, 1998) and 11-275808 (filed on Sep. 29, 1999), which are expressly incorporated herein by reference in their entireties.

DESCRIPTION OF THE PREFERRED EMBODIMENT

Preferred embodiments of the invention will be described in detail with reference to the accompanying drawings.

Figure 1:
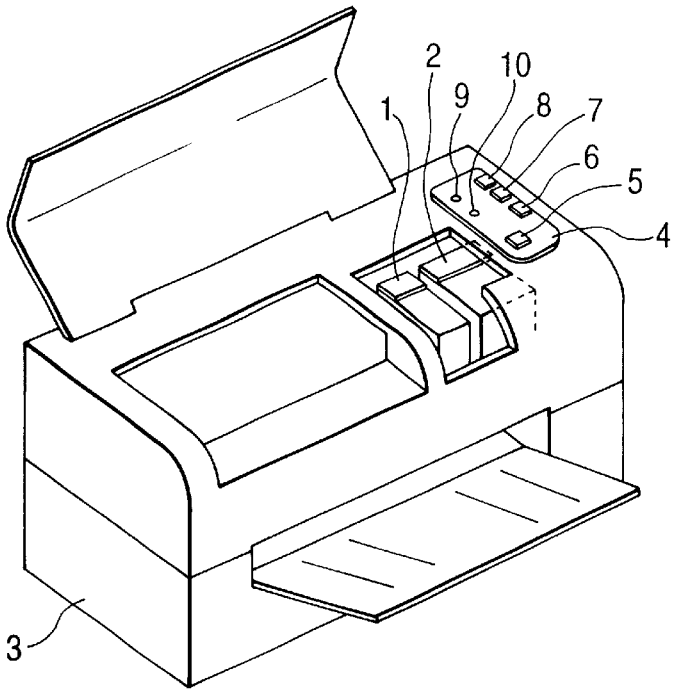
FIG. 1 is a perspective view showing an ink jet printing apparatus according to an embodiment of the invention.

FIG. 1 shows an ink jet printing apparatus according to an embodiment of the invention. The ink jet printing apparatus comprises a print mechanism (described later) located in a print area and ink cartridges 1 and 2 located in a non-print area. The print mechanism and the ink cartridges 1 and 2 are housed in a case 3.

An operation panel 4 is provided on the external face of the case 3, which has a power switch 5, an ink cartridge replacement command switch 6, a black head cleaning command switch 7, a color head cleaning command switch 8, and indicators 9 and 10 for notifying a user of ink ends of the black and color ink cartridges and other alarming matters.

Figure 2:
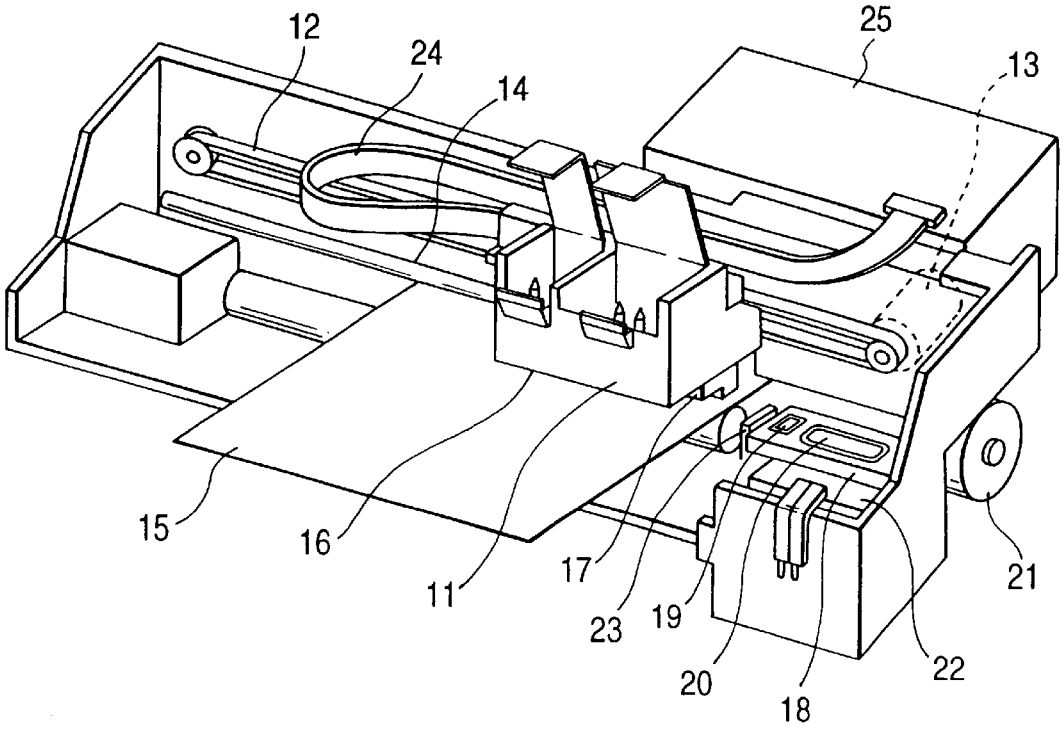
FIG. 2 is a perspective view showing an example of a printing mechanism installed in the ink jet printing apparatus.

FIG. 2 shows the print mechanism. A carriage 11 is connected to a carriage drive motor 13 through a timing belt 12 to reciprocate in parallel to a platen 14. A print head 16 for ejecting black ink and a print head 17 for ejecting color ink are fixed to the carriage 11 to be confronted with a recording sheet 15. As illustrated, the print head 16 is located at a left-hand side (a print area side) and the print head 17 is located at a right-hand side (a non-print area side).

A capping unit 18 is disposed in the non-print area, which has a cap 19 for sealing the black ink print head 16 and a cap 20 for sealing the color ink print head 17. The caps 19 and 20 are mounted on a single slider. A pump unit 22 made up of two pumps driven by a motor 21 is connected through tubes to the caps 19 and 20 so as to independently apply negative pressure to the caps 19 and 20.

The cap 19, 20 has a size capable of sealing a nozzle opening face of the corresponding print head 16, 17. Each of the caps 19 and 20 is made of elastic material such as rubber, and formed into a cup shape defining a space sealingly and entirely circumscribing the nozzle opening face of the corresponding print head 16, 17. The caps 19 and 20 respectively seal the nozzle opening faces of the print heads 16 and 17 when printing is not carried out, and discharge ink forcibly from the print heads 16 and 17 by negative pressure from the pump unit 22 when the ejecting capability recovery operation is carried out or when the ink cartridges 1 and 2 are replaced. A cleaning unit 23 is disposed in the vicinity of the capping unit 18, which has a wiping blade to be brought into contact with the nozzle opening faces of the print heads 16 and 17 by the action of a not-shown drive source.

The print heads 16 and 17 mounted on the carriage 11 and the storage systems described later are connected to a controller 25 through a flexible cable 24.

Figure 3A:
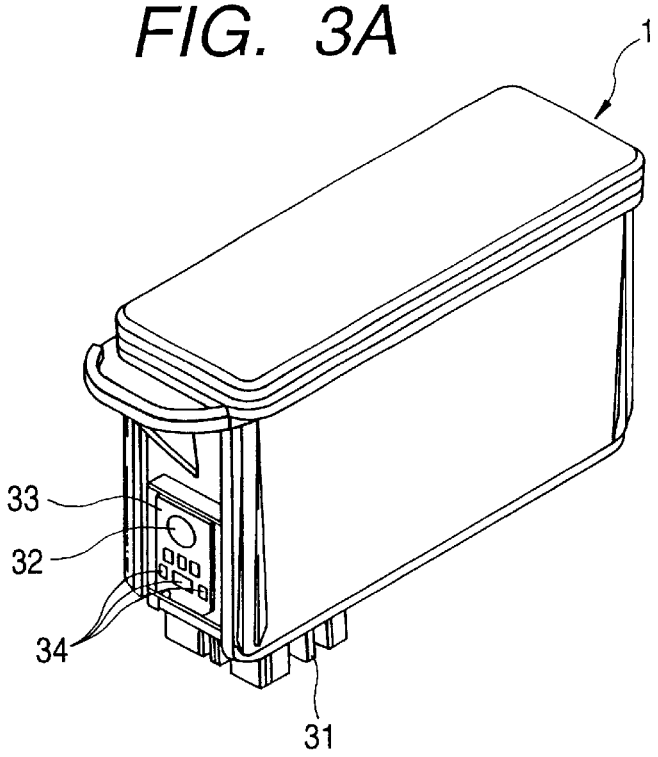
FIGS. 3A and 3B are perspective views showing examples of ink cartridges for the ink jet printing apparatus.
Figure 3B:
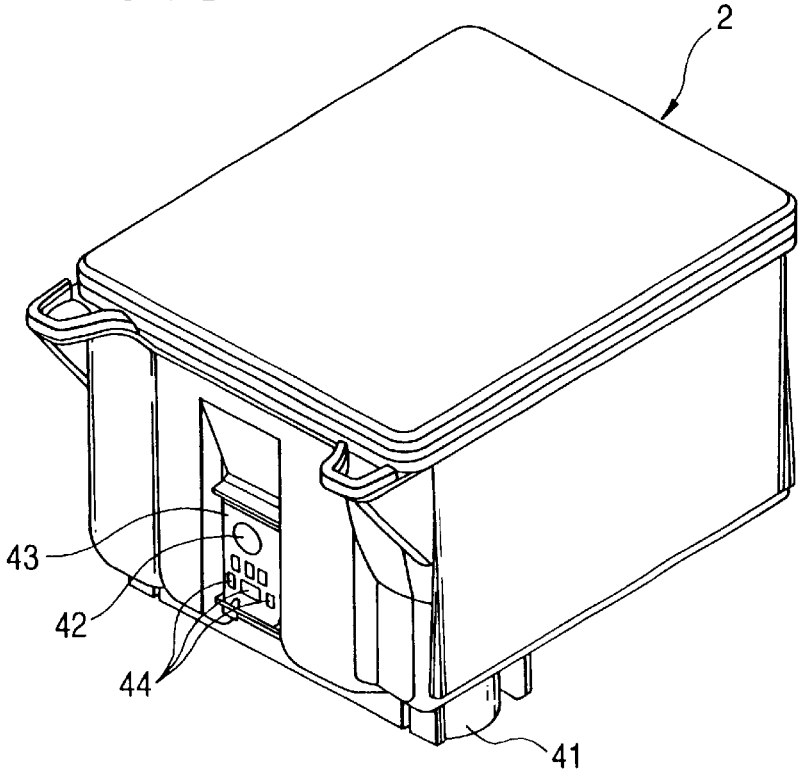

FIGS. 3A and 3B respectively show examples of the black ink cartridge 1 and the color ink cartridge 2. Rewritable storage systems 32 and 42 ex. semiconductor memory (EFPROM, Flash Momory) are provided on the faces of the cartridges 1 and 2 to be confronted with the carriage 11 when the black and color print heads 16 and 17 are attached to the carriage 11 (in the embodiment, on the side faces of the cartridges 1 and 2 close to ink supply ports 31 and 41).

Each of the storage systems 32 and 42 stores the following data as non-rewritable, fixed data:

(1) ID data for identifying the ink cartridge;

(2) manufacturing date;

(3) expiration date (guaranteed service life);

(4) data for specifying adaptable printing apparatuses; and (5) ink capacity.

These data are stored in the storage systems 32, 42 at the time when the cartridge 1, 2 is shipped from a factory.

Further, each of the storage systems 32 and 42 has a memory area in which the following data in a state where the cartridge 1, 2 is mounted to the print apparatus can be stored:

(1) attachment period to the printing apparatus (for example, a time point at which the cartridge is mounted to the printing apparatus);

(2) ink remaining amount; and (3) data concerning the number of times maintenance has been executed by the printing apparatus and the degree of each maintenance.

Figure 4A:
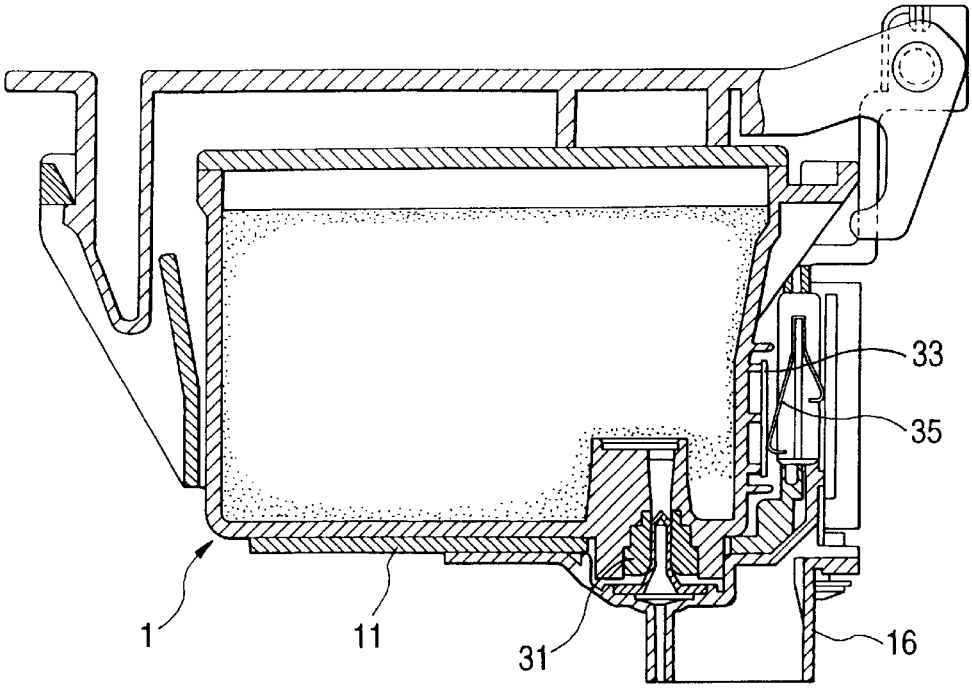
FIGS. 4A and 4B are sectional views of the ink cartridges in FIGS. 3A and 3B in a state in which the ink cartridges are attached to a carriage.
Figure 4B:
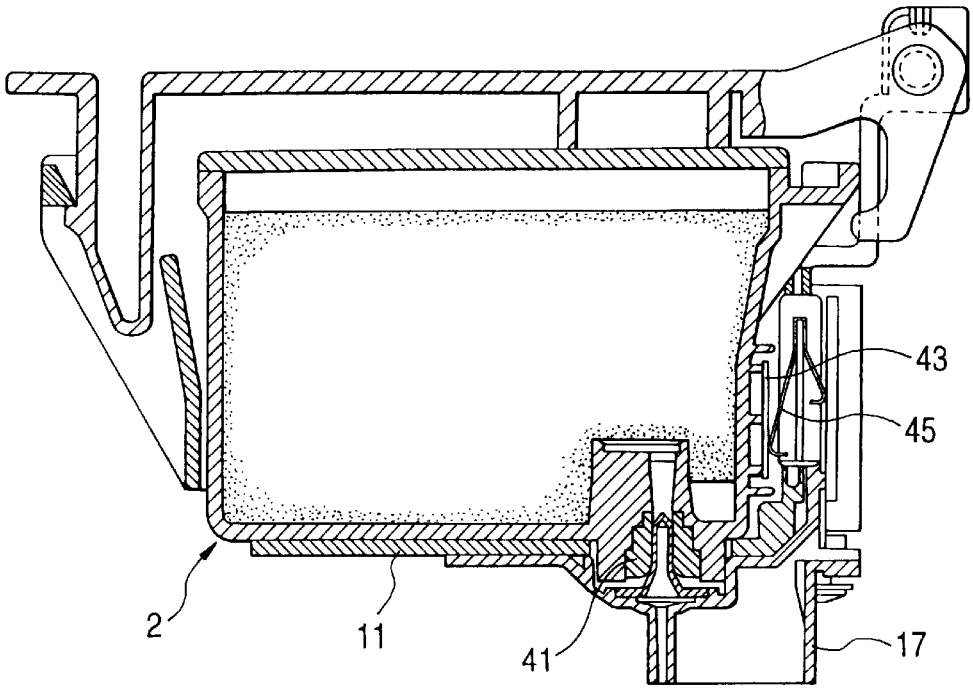

The storage systems 32, 42 are connected to the controller 25 through contacts 35, 45 of the carriage 11 as shown in FIGS. 4A and 4B via externally connectable contacts 34 and 44 formed on circuit boards 33 and 43 on which the storage systems 32 and 42 are mounted. With this arrangement, data stored in the storage systems 32, 42 can be read, and data in a storage system provided in the printing apparatus can be written on the storage systems 32 and 42.

Figure 5:
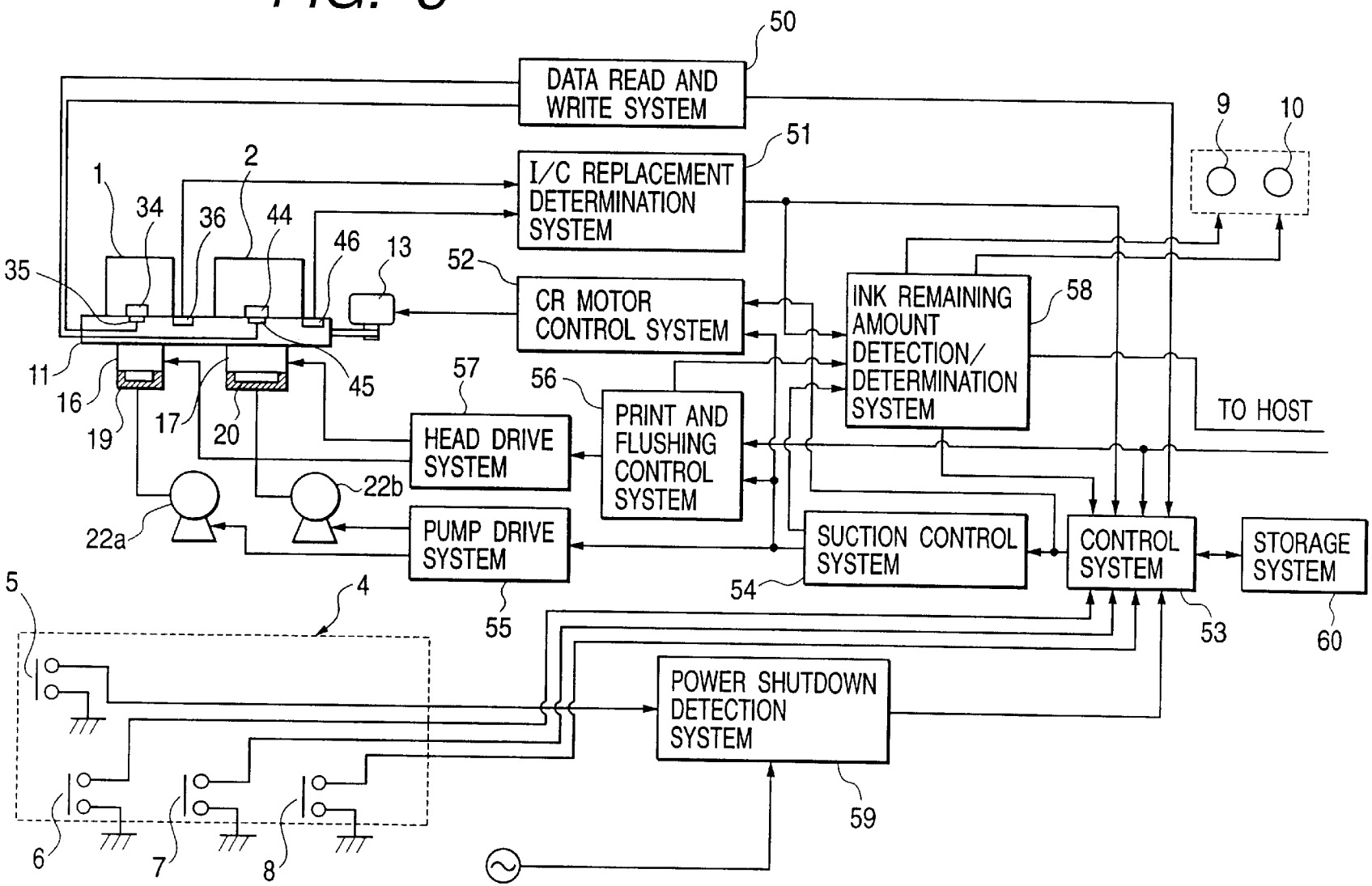
FIG. 5 is a block diagram showing an example of a control system for the ink jet printing apparatus.

FIG. 5 shows an example of a controller for executing the ink cartridge replacement operation of the printing apparatus and removing clogging. A data read and write system 50 is connected to the contacts 34 and 44 of the ink cartridges 1 and 2 through the contacts 35 and 45 of the carriage 11 to read data stored in the storage systems 32 and 42 of the ink cartridges 1 and 2 and write data stored in the storage system (described later) onto the storage systems 32 and 42 of the ink cartridges 1 and 2.

An ink cartridge replacement determination system 51 receives signals from switches 36 and 46 to detect the attachment and detachment of the ink cartridges 1 and 2. The switches 36 and 46 are so disposed on faces of carriage 11 as to be depressed by the ink cartridges 1 and 2 upon the attachment of the ink cartridges 1 and 2 (in the embodiment, they are disposed on the cartridge reception faces of the carriage 11).

A carriage motor control system 52 is controlled by the control system 53 to reciprocate the carriage 11 during printing, and move the print heads 16 and-17 to the capping position when the ejection capability recovery operation is designated.

A suction control system 54, under the control by the control system 53, seals the print heads 16 and 17 by the capping unit 18 and controls the suction force and suction time of each of suction pumps 22*a* and 22*b* of the pump unit 22 through a pump drive system 55, thereby discharging ink forcibly from the print heads 16 and 17 during the ink ejection capability recovery operation, and filling ink from the ink cartridges 1 and 2 to the print heads 16 and 17 for ready for printing when the ink cartridges are replaced with the cartridges 1 and 2.

A print and flushing control system 56 outputs drive signals to the print heads 16 and 17 through a head drive system 57 to eject ink droplets from the print heads 16 and 17 based on print data from a host, thereby executing printing. The print and flushing control system 56 outputs similar drive signals to the print heads 16 and 17 located at a flushing position, such as the capping position, to eject ink droplets of viscosity-increased ink from all nozzle openings to an ink receiver.

An ink remaining amount detection/determination system 58 calculates the ink remaining amount of the ink cartridge 1, 2 on the basis of the number of dots formed as a consequence of printing, the number of ink droplets ejected by the flushing operation, and the ink amount consumed by the filling operation and the cleaning operation.

A power shutdown detection system 59 detects on/off operation of the power switch 5 and outputs a signal indicating the on or off state. When the operation for turning off the power is performed, the power shutdown detection system 59 executes a predetermined post-processing, and then stops the supply of power to the printing apparatus.

The control system 53 receives signals from the ink cartridge replacement command switch 6 and the cleaning command switches 7 and 8 on the operation panel 4, the power shutdown detection system 59, the ink remaining amount detection/determination system 58, and the host to execute the overall control for the operation of power on processing, power off processing, cleaning processing, ink remaining amount check processing, print processing, ink cartridge replacement processing, etc. The control system 53 controls the storage system 60 store therein various statuses occurring in association with the replacement of the ink cartridges 1 and 2 when the power off processing is executed.

Figure 6:
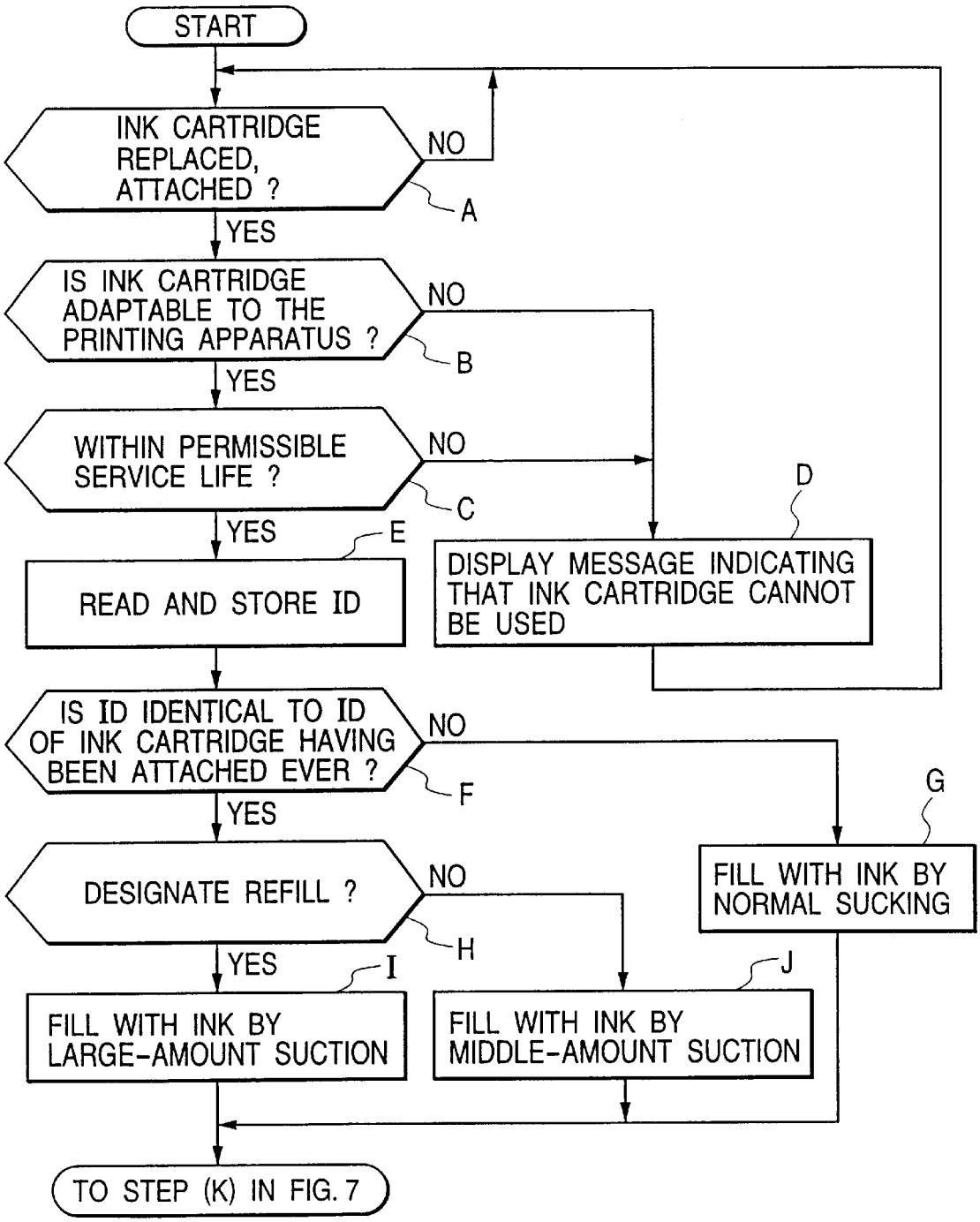
FIG. 6 is a flowchart showing an operation from attachment of ink cartridge to filling the print head with ink when ink cartridge is replaced in the ink jet printing apparatus.

The operation of the printing apparatus thus constructed will be discussed with reference to flowcharts shown in FIGS. 6 and 7.

When the ink cartridge 1, 2 the black ink cartridge 1 and/or the color ink cartridge 2) is attached to the print head 16, 17 at step A, the ink cartridge replacement determination system 51 outputs a signal. The control system 53 reads the manufacturing date, the expiration date, the data for specifying adaptable printing apparatuses, the ink capacity, etc., of the ink cartridge, which were previously stored at the factory shipment, from the storage system 32, 42 of the ink cartridge 1, 2 through the data read and write system 50 to determines whether or not the ink cartridge 1, 2 is adaptable to the printing apparatus at steps B and C. If the ink cartridge 1, 2 is not adaptable to the printing apparatus or exceeds the expiration date, a message indicating that the ink cartridge 1, 2 cannot be used is displayed on the indicator 9, 10 on the operation panel 4 or on the display of the host, and the printing apparatus or the host awaits the replacement of the ink cartridge 1, 2 at step D.

If it is determined that the ink cartridge 1, 2 can be used, the ID data of the ink cartridge 1, 2 is read from the storage system 32, 42 and stored in the storage system 60 of the printing apparatus or the host at step E. At step F, it is determined whether the ID data of the currently attached ink cartridge 1, 2 and the ID data of the previously attached ink cartridge are identical or not. If it is determined that they are identical, the carriage 11 is moved to the capping position and the pump unit 22 is driven to suck ink from the ink cartridge 1, 2 in a normal suction amount, thereby filling the print head 16, 17 with the ink at step G. In addition, if it is determined that they are not identical and if the previous ID data does not exist, ink is sucked in a suction amount slightly larger than the normal suction amount to execute the initial filling since this attachment is the first time for the ink cartridge 1, 2 to be attached to the printing apparatus.

On the other hand, if the ID data of the currently attached cartridge 1, 2 is identical to the ID data of the previously attached ink cartridge and if the user designates a refill product through a switch, etc. at step H, ink is sucked in a larger suction amount larger than the normal suction amount at step I to surely discharge air bubbles from the print head 16, 17 because the cartridge 1, 2 would be subjected to refilling under atmospheric pressure, and the degree of degasification in the cartridge 1, 2 would be poor.

If no designation of a refill product is made, the possibility that the ink cartridge 1, 2 is again attached is high (it is reasonable to determine that the ink cartridge 1, 2 has ever been attached to the printing apparatus) Therefore, the ink in the ink cartridge 1, 2 is basically high in degasifying degree because of being filled at the factory but is slightly lowered in degasifying degree due to the periodical lapse. For this reason, the suction is carried out at a middle suction amount larger than the amount (i.e. the normal suction amount) of the normal recovery operation at step J to discharge the air bubbles that enter into the print head 16, 17 in association with the detachment and attachment of the ink cartridge 1, 2.

The ink amount discharged from the ink cartridge 1, 2 by the filling operation is calculated as the product of the suction amount per unit time and the duration, and the result is stored in the ink remaining amount detection/determination system 58 as an ink consumption amount.

Figure 7:
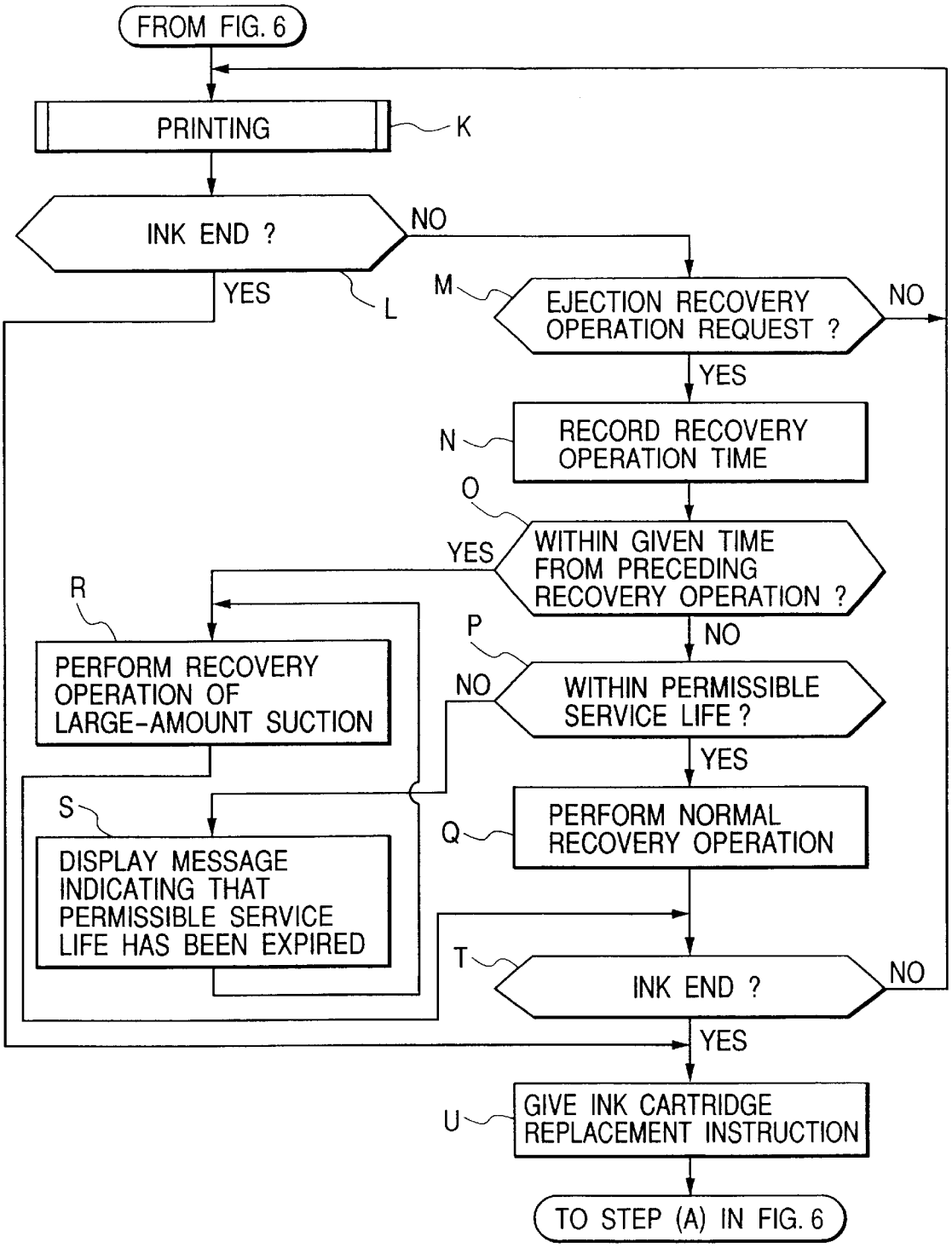
FIG. 7 is a flowchart mainly showing an operation performed after the print head is filled with ink when ink cartridge is replaced in the ink jet printing apparatus.

Upon reception of a printing signal after the filling the print head 16, 17 with ink is completed, the printing is executed with the print head 16, 17 under the control of the control system 53 at step K in FIG. 7. The ink droplets ejected from the print head 16, 17 during the printing are added up as the ink consumption amount by the ink remaining amount detection/determination system 58, and the result is stored.

After the print operation is continued for a predetermined time, the control system 53 moves the carriage 11 to set the print head 16, 17 at a position where the print head 16, 17 can be flushed, and controls the print and flushing control system 56 so that a predetermined number of ink droplets are ejected from the print head 16, 17.

Thus, viscosity-increased ink in the proximity of the nozzle openings of the print head 16, 17 is discharged to prevent the nozzle openings from being clogged. The ink droplets discharged during the flushing operation are added up as the ink consumption amount by the ink remaining amount detection/determination system 58. If the ink end is detected during the print process at step L, an instruction for replacing the ink cartridge is given at step U and the replacement of the ink cartridge 1, 2 is awaited at step A in FIG. 6.

The printing operation is continued unless no ink remains in the ink cartridge 1, 2. However, if clogging is not removed by executing the flushing operation and incomplete dots are detected by visual inspection of the user or by an incomplete dot detection system, the cleaning command switch 7, 8 is operated by the user or automatically to issue an ejection recovery request command at step M.

The print head 16, 17 is moved to a position where the print head 16, 17 can be capped, and then the time point at which this command is issued is recorded at step N, so as to obtain a periodical interval from the preceding ejection recovery operation at step 0 and determine whether or not the time point is within the permissible service life counted from the manufacturing date at step P. If the time point exceeds the permissible service life, a message indicating that the permissible service life has been expired is displayed at step S.

If the interval from the preceding ejection recovery operation is long and the cartridge 1, 2 is in the permissible service life at step P, normal suction force is exerted, namely, the pump 22*a*, 22*b* is driven at low speed, whereby negative pressure acts on the nozzle openings of the print head 16, 17 and a small amount of ink is forcibly discharged from the print head 16, 17 to the cap 19, 20 to execute the normal recovery operation at step Q.

On the other hand, if the time from the preceding ejection recovery operation is short or the cartridge 1, 2 is outside of the permissible service life, strong suction force is exerted, namely, the pump 22*a*, 22*b* is driven at high speed, whereby strong negative pressure acts on the nozzle openings of the print head 16, 17 and a large amount of ink is forcibly discharged from the print head 16, 17 to the cap 19, 20 to execute the strong recovery operation of large-amount suction at step R.

The ink amount of this recovery operation is added up as the ink consumption amount by the ink remaining amount detection/determination system-58. The print amounts, such as the number of characters, the number of lines, and the number of pages, from the preceding cleaning operation, which are temporarily stored in the storage system 60, are reset, whereas the print amounts from the preceding cleaning performed for the black ink print head 16 and the color ink print head 17 are again stored in the storage system 60 in relation to and together with the cleaning histories of the black ink print head 17 and the color ink print head 18.

After the cleaning operation is completed, the ink amount remaining in the ink cartridge 1, 2 is determined at step T. If it is determined that ink remains to such an extent that the print operation can be continued, the program advances to the step K where the printing is executable based on the print data. If the ink end is detected due to the consumption of the ink by the recovery operation, an instruction for replacing the ink cartridge is given at step U and the replacement of the ink cartridge is awaited at step A in FIG. 6.

Preferably, the determination is made, prior to the recovery operation, as to whether or not ink remains in the ink cartridge more than the ink amount consumed by the recovery operation is determined preliminarily, and the ejection recovery operation is performed only if it is determined that ink remains to such an extent that print can be executed still after the recovery operation, or small-amount suction is executed to such an extent that ink remains in the ink cartridge 1, 2 still after the recovery operation. This prevents solidification of ink in the print head 16, 17 due to the lacking of the ink in the print head 16, 17.

In a case where the user again operates the cleaning command switch 7 or 8 within a short time period after the cleaning operation is actually performed, the control system 53 reads a cleaning cycle, i.e. the print amount from the preceding cleaning operation, from the storage system 60. In this case, since the cleaning is designated by the user without conducting the substantive amount of the printing, a continuous cleaning command is given.

In response to the continuous cleaning command, the control system 53 moves the print head 16, 17 to a position where the print head 16, 17 can be capped, and then drives the pump 22*a*, 22*b* at higher speed than the preceding speed, thereby sucking ink from the print head 16, 17 with comparatively strong negative pressure.

Accordingly, ink is discharged from the nozzle openings of the print head 16, 17 at a comparatively large flow quantity. The ink amount thus discharged is added up as the ink consumption amount by the ink remaining amount detection/determination system 58. The print amount from the preceding cleaning command, stored in the storage system 60 is reset Whenever a cleaning operation command is given, the cleaning mode indicative of the strength of cleaning and the print amount from one cleaning operation to another are stored as a cleaning history in relation to and together with the ID data of the ink cartridge 1, 2.

In response to the output signal from the power shutdown detection system 59 as a consequence of the operation of the power switch 5 after the printing is completed, the control system 53 drives, via the carriage motor control system 52, the carriage 11 to the capping position to sealing the print head 16, 17 with the cap 19, 20. Concurrently, the control system 53 reads data from the storage system 60, and outputs the data to the storage system 32, 42 of the ink cartridge 1, 2 via the data reading/writing system 50. Thus, the data stored in the storage system 60 are written onto and stored in the storage system 32, 42 of the ink cartridge 1, 2.

If the power switch 5 is turned on again to execute printing, the control system 53 reads the ID data, the remaining ink amount, and the history data concerning executed cleaning from the storage system 32, 42 of the ink cartridge 1, 2, and stores these data in the storage system 60 of the printing apparatus.

In response to the input of a print signal from the host, the control system 53 controls the print head 16, 17 and the carriage motor 13 to execute printing, and calculates the ink consumption amount through the ink remaining amount detection/determination system 58 by summing the ink droplets ejected during the printing.

By the way, if the ink cartridge replacement command switch 6 is pressed mistakenly by the user, etc., the control system 53 transfers the cleaning history data stored in the storage system 60 to the storage system 32, 42 of the ink cartridge 1, 2 to store the data therein, and subsequently moves the carriage 11 to the ink cartridge replacement position where the user can remove the ink cartridge 1, 2 from the printing apparatus.

If the user notices the mistake and again attaches the just-removed ink cartridge 1, 2 to the print head 16, 17, the ink cartridge replacement determination system 51 outputs a signal, upon which the control system 53 reads the ID data from the storage system 32, 42 of the ink cartridge 1, 2 and compares the read ID data with the ID data stored in the storage system 60 at step F.

If it is determined as a consequence of the comparison that the read ID data is identical to the ID data stored in the storage system 60, the control system 53 determines that the ink cartridge is again attached to thereby execute the ink filling operation in the reattachment mode. Thus, even if air bubbles enter into the print head 16, 17 at an amount larger than an amount at which air bubbles enter when anew ink cartridge is attached, the air bubbles can be surely removed and the print head 16, 17 can be surely filled with ink.

On the other hand, if all ink in the ink cartridge 1, 2 has been consumed and a new ink cartridge 1, 2 is attached, the ID data of the new ink cartridge 1, 2 differs from the ID data stored in the storage system 60. Therefore, the control system 53 determines that the ink cartridge now attached is a new product.

In a case where the ink cartridge 1, 2 is designed to detect the actual ink remaining amount, it is possible to determine whether or not the ink cartridge is refilled with ink, on the basis of the ink remaining amounts detected before the ink cartridge is detached and after the ink cartridge is attached, and the ID data of the ink cartridge. Therefore, aprocessing following this determination is executed.

That is, if the ID data before the ink cartridge is detached is the same as that after the ink cartridge is attached and the ink remaining amount increases, it can be estimated that the user refills the ink cartridge with ink.

Ink in the ink cartridge after being refilled is extremely low in degasifying degree as compared with a genuine product, thus the air that has entered into the print head in association with the detachment and attachment operation of the ink cartridge is difficult to be solved into the ink. Therefore, in this case, a large amount of ink is sucked after the ink cartridge is again attached, to thereby discharge the remaining air bubbles from the print head.

Figure 8:
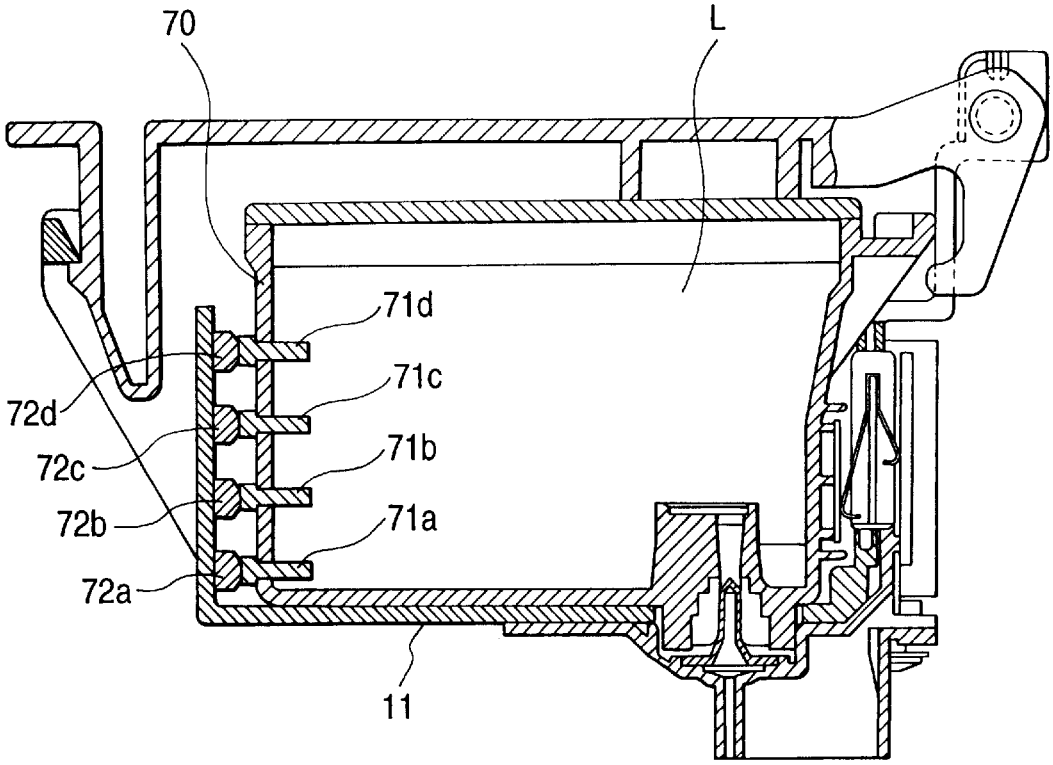
FIG. 8 is a sectional view showing another example of an ink cartridge that is attached to the carriage.

FIG. 8 shows an example of the ink cartridge designed to detect the actual ink remaining amount. Aplurality of electrodes 71*a* to 71*d* are arranged vertically to penetrate a wall of a container 70 forming a part of the ink cartridge. On the other hand, the carriage 11 has contacts 72*a* to 72*d* coming in contact with the electrodes 71*a* to 71*d* when the ink cartridge is attached. The lowermost electrode 71*a* is used as one electrode, and the other electrodes 71*b* to 71*d* are used as detection electrodes. By detecting the uppermost electrode electrically conducting the lowermost electrode 71*a*, the liquid level L of ink can be detected.

The ink cartridge 1, 2 detached from the printing apparatus is returned from the user through a retail shop, etc. to the manufacturer.

The manufacturer can read the data from the storage system 32, 42 provided to the ink cartridge 1, 2 to recognize the print operation based on the data of the cleaning frequency, the cleaning strength, etc., in the actual operating environment of the printing apparatus. The manufacture can effectively use these data as basic data to improve the characteristic of ink and the structure of the printing apparatus.

There may arise a case that the ink cartridge is removed before it completely consume ink because of a print failure, etc., and the removed ink cartridge is returned to the manufacturer together with complaint of the user.

In this case, the manufacturer can read the data from the storage system 32, 42 provided to the ink cartridge 1, 2, and check whether or not the user follows the operation procedure and the operation method stipulated for the printing apparatus based on the data of the cleaning frequency, the cleaning strength, etc., of the user.

Therefore, the manufacture can give an appropriate advice to the user regarding operation procedure and method of the ink jet printing apparatus.

It is conceivable to provide a test print area, detect the test print area by an image detection system such as a charge coupled device (CCD), and store the detected test print area in the storage system 32, 42. That is, test print is executed with the print head 16, 17, and the state of dots in the test print area is detected by the image detection system to make it possible to automatically recognize and the operation state of the print head 16, 17 such as incomplete dots or lacking of dots. If this information as well as the cleaning history are stored in the storage system 32, 42 of the ink cartridge 1, 2, the manufacturer can more accurately recognize the operation state of the user's printing apparatus.

The invention has been described with reference to the printing apparatus of a type in which the ink cartridge is mounted onto the carriage. However, the invention should not be restricted thereto or thereby. For example, it is obvious that similar advantages are obtained in a case where the invention is applied to a printing apparatus of another type in which an ink cartridge is installed on a case of the printing apparatus and ink is supplied to a print head on a carriage through an ink supply tube.

What is claimed is:

1. An ink jet printing apparatus comprising:

a detachable ink cartridge having a rewritable storage system;

an ink jet print head which receives ink from the ink cartridge;

a cleaning system operated to recover an ink droplet ejection capability of the print head;

a data read and write system for the storage system, wherein the storage system has a storage area in which data on an operation history of the cleaning system can be stored.

2. The ink jet printing apparatus as claimed in claim 1, wherein the data on the operation history of the cleaning system includes the number of times the cleaning system has been operated.

3. The ink jet printing apparatus as claimed in claim 1, wherein the data on the operation history of the cleaning system includes an amount of ink consumed as a consequence of the operation of the cleaning system.

4. The ink jet printing apparatus as claimed in claim 1, wherein said cleaning system is operated at least at two stages, strong and weak cleaning modes, and the data on the operation history of the cleaning system includes data regarding which cleaning mode the cleaning system was operated.

5. The ink jet printing apparatus as claimed in claim 1, wherein the data on the operation history of the cleaning system includes the number of times the cleaning system has been operated per unit print amount.

6. The ink jet printing apparatus as claimed in claim 1, wherein the data on the operation history of the cleaning system is stored in the storage system when the ink cartridge is removed from the printing apparatus or when power for the printing apparatus is turned off.

7. The ink jet printing apparatus as claimed in claim 1, wherein the storage system stores identification data peculiar for the ink cartridge to distinguish the ink cartridge from other ink cartridges.

8. The ink jet printing apparatus as claimed in claim 1, wherein the storage system stores data indicative of adaptable printing apparatuses to which the ink cartridge is adaptable, and the printing apparatus refers to the data indicative of the adaptable printing apparatuses to give a notification if the printing apparatus is other than the adaptable printing apparatuses.

9. The ink jet printing apparatus as claimed in claim 1 wherein the storage system stores data indicative of at least one of ID identifying the ink cartridge, a manufacturing date of the ink cartridge, and a permissible service life of the ink cartridge as non-rewritable, fixed data.

10. The ink jet printing apparatus as claimed in claim 9 wherein the printing apparatus gives a notification on the basis of the data indicative of the permissible service life if the permissible service life has been expired.

11. The ink jet printing apparatus as claimed in claim 9, further comprising a second storage system which reads and stores ID data of ink cartridges, and an ink filling system which fills the print head with ink, wherein a state of an ink cartridge currently attached to the printing apparatus is determined based on whether or not the ID data stored in the second storage system includes the ID data identifying the currently attached ink cartridge, and the ink filling system is controlled based on the state of the currently attached ink cartridge thus determined.

12. The ink jet printing apparatus as claimed in claim 11, wherein the state of the currently attached ink cartridge includes whether or not the currently attached ink cartridge has ever been attached to the printing apparatus.

13. The ink jet printing apparatus as claimed in claim 11, wherein the ink filling system is selectively controlled based on whether or not an amount of ink in the currently attached ink cartridge is larger than an amount of ink in the currently attached ink cartridge at the time when the currently attached ink cartridge was previously detached from the printing apparatus.

14. The ink jet printing apparatus as claimed in claim 13, further comprising a system which specifies whether or not an amount of ink in the currently attached ink cartridge is larger than an amount of ink in the currently attached ink cartridge at the time when the currently attached ink cartridge was previously detached from the printing apparatus.

15. The ink jet printing apparatus as claimed in claim 1, further comprising an incomplete dot detection system which detects a state of dots printed with the print head during a test print, wherein the storage system stores information on the state of dots detected by the incomplete dot detection system.

16. The ink jet printing apparatus as claimed in claim 1, wherein the print head has a plurality of print head units that are mounted on a carriage and that respectively receive ink from a plurality of separate ink cartridge units of the ink cartridge, wherein data on the operation history of the cleaning system for one of the print head units is stored independently from data on the operation history for the other of the print head units.

17. The ink jet printing apparatus as claimed in claim 16 wherein the plurality of print head units includes at least a black ink print head and a color ink print head.

18. The ink jet printing apparatus as claimed in claim 17 wherein each of the ink cartridge units has a storage system which stores data on the operation history of the cleaning system for a corresponding one of the print head units.

19. An ink cartridge mountable to a printing apparatus having a carriage, and an ink jet print head mounted on the carriage, said ink cartridge comprising:

a container containing the ink therein; and a rewritable storage system provided to the container, and capable of storing data on a cleaning history of the printing apparatus.

20. The ink cartridge as claimed in claim 19, wherein the storage system stores data on at least one of ID identifying the ink cartridge, a manufacturing date of the ink cartridge, a permissible service life of the ink cartridge, and printing apparatus to which the ink cartridge is adaptable, as non-rewritable, fixed data when the ink cartridge is shipped from a factory.

21. The ink cartridge as claimed in claim 19, wherein the data on the cleaning history includes the number of times cleaning has been executed.

22. The ink cartridge as claimed in claim 19, wherein the data on the cleaning history include an amount of ink consumed by cleaning.

23. The ink cartridge as claimed in claim 19, wherein the data on the cleaning history includes a mode of cleaning executed by the printing apparatus.

24. The ink cartridge as claimed in claim 19, wherein the data on the cleaning history includes the number of times cleaning has been executed per unit print amount.

25. The ink cartridge as claimed in claim 19 wherein said storage system stores the data on the cleaning history outputted when the ink cartridge is detached from the printing apparatus or when power of the printing apparatus is turned off.

26. A method of controlling maintenance operation for a print head to which ink is supplied from ink cartridge having a storage system, the ink cartridge being detachable from a printing apparatus, the method comprising the steps of:

reading, from the storage system, data indicative of an ink amount of the ink cartridge when the cartridge is attached to the printing apparatus or the printing apparatus is turned on;

controlling the maintenance operation based on the data indicative of the ink amount while monitoring a consumed ink amount consumed as a consequence of printing and maintenance operation;

updating the data indicative of the ink amount based on the consumed ink amount; and storing the thus updated data in the storage system when the ink cartridge is detached from the printing apparatus or the printing apparatus is tuned off.

27. A method of controlling maintenance operation for a print head to which ink is supplied from ink cartridge having a storage system, the ink cartridge being detachable from a printing apparatus, the method comprising the steps of:

reading, from the storage system, data indicative of a history of the maintenance operation executed previously in relation to the ink cartridge attached to the printing apparatus;

executing maintenance operation controlled based on the data indicative of the history of the maintenance operation;

updating the data indicative of the history of the maintenance operation based on the thus executed maintenance operation; and storing the thus updated data in the storage system.

28. A method of filling a print head with ink when an ink cartridge is attached to a printing apparatus, the method comprising the steps of:

trying to read, from an ink cartridge, data indicative of at least one of a manufacturing date of the ink cartridge, an expiration date of the ink cartridge, adaptable printing apparatuses to which the ink cartridge is adaptable, and an ink capacity of the ink cartridge, when the ink cartridge is attached to the printing apparatus, and determining whether the ink cartridge can be used for the printing apparatus;

informing a user that the ink cartridge cannot be used for the printing apparatus if the data cannot be read or if it is determined based on the data read from the ink cartridge that the ink cartridge cannot be used for the printing apparatus;

reading an ID data from the cartridge if it is determined that the ink cartridge can be used for the printing apparatus, and determining whether the ID data thus read is contained in ID data previously stored in a storage system of the printing apparatus;

filling the print head with ink at a normal suction amount if it is determined that the ID data thus read is not contained in ID data previously stored in the storage system;

determining whether or not the ink cartridge was refilled prior to attachment of the ink cartridge to the printing apparatus if it is determined that the ID data thus read is contained in ID data previously stored in the storage system;

filling the ink cartridge with ink at a large suction amount larger than the normal suction amount if it is determined that the ink cartridge was refilled; and filling the ink cartridge with ink at a middle suction amount larger than the normal suction amount but smaller than the large suction amount if it is determined that the ink cartridge was not refilled.

29. A printing apparatus, comprising:

a first ink cartridge having a first memory physically located at the ink cartridge, wherein the first ink cartridge is installed in the printing apparatus and wherein the first memory stores first identification that particularly identifies the first ink cartridge;

a second memory in which second identification data i s stored, wherein the second identification data particularly identifies an ink cartridge that was previously installed in the printing apparatus;

a controller that reads the first identification data from the first memory, reads the second identification data from the second memory, and determines if the first identification corresponds to the second identification data; and a print head that receives ink from the ink cartridge, wherein the controller instructs the printing apparatus to fill the print head at a normal suction amount if the first identification data does not correspond to the second identification data, wherein the controller determines if the first ink cartridge was refilled prior to installation, wherein if the first ink cartridge was refilled prior to installation and the first identification data corresponds to the second identification data, the controller instructs the printing apparatus to fill the print head at a large suction amount, and wherein the large suction amount is greater than the normal suction amount.

30. The printing apparatus as claimed in claim 29, wherein if the first ink cartridge was not refilled prior to installation and the first identification data corresponds to the second identification data, the controller instructs the printing apparatus to fill the print head at a middle suction amount, and wherein the middle suction amount is greater than the normal suction amount and less than the large suction amount.

* * * * *